US006253591B1

(12) United States Patent
Sayama et al.

(10) Patent No.: US 6,253,591 B1
(45) Date of Patent: Jul. 3, 2001

(54) METHOD AND APPARATUS FOR BENDING A METALLIC FLANGED MEMBER

(75) Inventors: Mitsuru Sayama; Shin Ihara; Kazuya Okada; Toshiyuki Yokoyama, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/520,610

(22) Filed: Mar. 7, 2000

(30) Foreign Application Priority Data

Mar. 9, 1999 (JP) ..... 11-062231

(51) Int. Cl.[7] ..... B21D 7/06

(52) U.S. Cl. ..... 72/167; 72/168; 72/173; 72/307

(58) Field of Search ..... 72/167, 168, 171, 72/173, 307, 276, 467, 411

(56) References Cited

U.S. PATENT DOCUMENTS

| | | | | |
|---|---|---|---|---|
| 1,158,294 | * | 10/1915 | Robinson | 72/167 |
| 1,697,896 | * | 1/1929 | Yates | 72/167 |
| 2,093,933 | * | 9/1937 | Sinclair | 72/167 |
| 3,339,392 | * | 9/1967 | Buckwalter | 72/167 |
| 3,782,164 | * | 1/1974 | Felker | 72/467 |
| 4,266,417 | * | 5/1981 | Imamura | 72/167 |
| 4,624,121 | * | 11/1986 | Kitsukawa | 72/307 |
| 5,119,533 | * | 6/1992 | Shimokata | 72/307 |
| 5,156,036 | * | 10/1992 | Michaels | 72/467 |
| 5,884,517 | * | 3/1999 | Yogo | 72/307 |

FOREIGN PATENT DOCUMENTS

| | | |
|---|---|---|
| 51-123760 | 10/1976 | (JP) . |
| 8-257643 | 10/1996 | (JP) . |

* cited by examiner

*Primary Examiner*—Daniel C. Crane
(74) *Attorney, Agent, or Firm*—Armstrong, Westerman, Hattori, McLeland & Naughton, LLP

(57) ABSTRACT

A method for bending a metallic flanged member includes the steps of applying a compressive force to a flange 2 of a metallic flanged member 1 in a direction that intersects a longitudinal direction of the metallic member for compression plastic deformation of the flange, and thereafter bending the metallic flanged member 1 along a flanged side thereof in such a manner that the flanged side of the metallic flanged member is situated on an inner side of a bending process, and an apparatus for use with the same method.

5 Claims, 10 Drawing Sheets

METHOD AND APPARATUS FOR BENDING A METALLIC FLANGED MEMBER

BACKGROUND OF THE INVENTION

1. Field of the Invention

The present invention relates to a method and apparatus for bending a metallic flanged member such as an aluminum alloy flanged hollow extruded material.

2. Description of the Related Art

When trying to bend a channel steel in such a manner that a flange thereof is situated on an inner side of a bending process, the flange buckles and then deforms in a wavy fashion. This causes such drawbacks as the channel steel looks poor, it becomes difficult to bring a member into tight contact with the flange so deforming, and the bending rigidity is largely reduced. Conventionally, in order to cope with these drawbacks, there is made a V-shaped cut in the flange from the edge thereof, and after the channel steel is bent, the V-cut edges are welded together directly or via a V-shaped piece. However, this increases bending processes and hence reduces the productivity, leading to high production costs. Moreover, it reduces the reliability in terms of strength.

Described as an improvement to the aforesaid conventional method in Japanese Patent Unexamined Publication No. SHO 51-123760 is a channel steel bending method comprising the steps of forming holes in the root portion of the flange, and thereafter bending the channel steel along the surface of the flange in such a manner that the flange is situated on an inner side of a bending process.

According to the bending method described in Japanese Unexamined Patent Publication No. SHO 51-123760, since holes are formed in the root portion of the flange, the bending rigidity along the flanged surface of the channel steel is reduced, and when trying to bend the channel over a long range with a large radius of curvature, man-hours are increased to form holes to make it possible to thereby lower the productivity. Moreover, reduction in bending rigidity of the channel steel is inevitable.

SUMMARY OF THE INVENTION

The present invention relates to an improved method and apparatus for bending a metallic flanged member that can solve the above problem.

According to a first aspect of the invention, there is provided a method for bending a metallic flanged member comprising the steps of applying a compressive force to a flange of a metallic flanged member in a direction that intersects a longitudinal direction of the metallic member for compression plastic deformation of the flange, and thereafter bending the metallic flanged member along a flanged side thereof in such a manner that the flanged side of the metallic flanged member is situated on an inner side of a bending process.

Accordingly, a tensile force is imparted to the flange in the longitudinal direction of the metallic member to thereby cause therein a large tensile strain, and there is caused in the flange a tensile plastic deformation in the longitudinal direction of the metallic member.

Due to this, following this, when trying to the metallic flanged member along the flanged side in such a manner that the flanged side is situated on the inner side of a bending process, there is caused a compressive force to be applied to the flange in a direction opposite to the aforesaid tensile plastic deformation, and the flange is then made subject to a low yield compression stress to thereby cause a compression plastic deformation of the flange (normally referred to as Bauschinger effect). As a result of this, the flange is prevented from deforming in a wavy fashion and therefore the metallic flanged member can easily and securely be bent with the flange being kept nearly flat. Consequently, no post process is needed to restore the flatness in the flange and a component such as a weather strip rubber can directly be attached to the flange with high accuracy and efficiency, thereby making it possible to reduce the production costs.

In addition, the compressive force may be directed in a thickness direction of the flange being a direction perpendicular to the flange surface. Accordingly, the flange can easily and securely be subject to a compression strain and thereafter it can easily be bent utilizing the Bauschinger effect.

Further, the amount of the compression plastic deformation may be increased as the bending radius of the metallic flanged member decreases. Thus, a compression plastic deformation can be generated which conforms to the bending deformation amount of the metallic flanged member, whereby the metallic flanged member can be bent rationally efficiently without causing any wavy deformation in the flange in the thickness direction thereof.

According to a second aspect of the invention, there is provided an apparatus for bending a metallic flanged member including: a receiving member slidably supporting the metallic flanged member and abutting against one surface of a flange of the metallic flanged member; a press member integrally fixed to the receiving member, the press member having an abutment surface abutting against the other surface of the flange to thereby form a gap between the abutment surface and an abutment surface of the receiving member abutting against the one surface of the flange, the gap being gradually reduced from one end of the flange to the other end thereof; and a slidably driving unit slidably moving the metallic flanged member from a side where the gap formed between the abutment surface of the receiving member and the abutment surface of the press member is wider toward a side where the gap is narrower.

With thus structure, a series of compression plastic deformation and bending can be carried out simultaneously, whereby bent metallic flanged members with high accuracy and quality can be produced with efficiency at low costs.

BRIEF DESCRIPTION OF THE INVENTION

DETAILED DESCRIPTION OF THE PREFERRED EMBODIMENTS

An embodiment of the present invention shown in FIGS. 1 to 14 will be described below.

Figure 7:
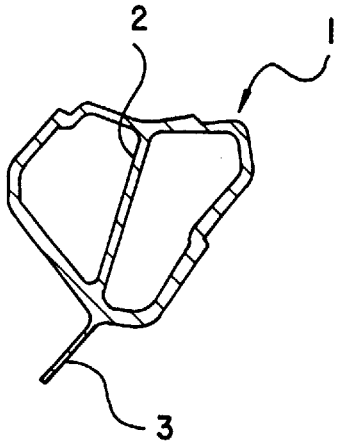
FIG. 7 is a cross-sectional view taken along the line VII—VII of FIG. 1.

A metallic flanged member to which the present invention is applied is a roof side frame 1 for an automobile which comprises a hollow extruded member of an aluminum alloy referred to as AL6063T5 and formed by adding magnesium and silicone into aluminum. As shown in FIG. 7, a reinforcement wall 2 is integrally formed inside a hollow portion of the roof side frame 1 and a flange 3 is integrally formed underneath the reinforcement wall 2.

Figure 1:
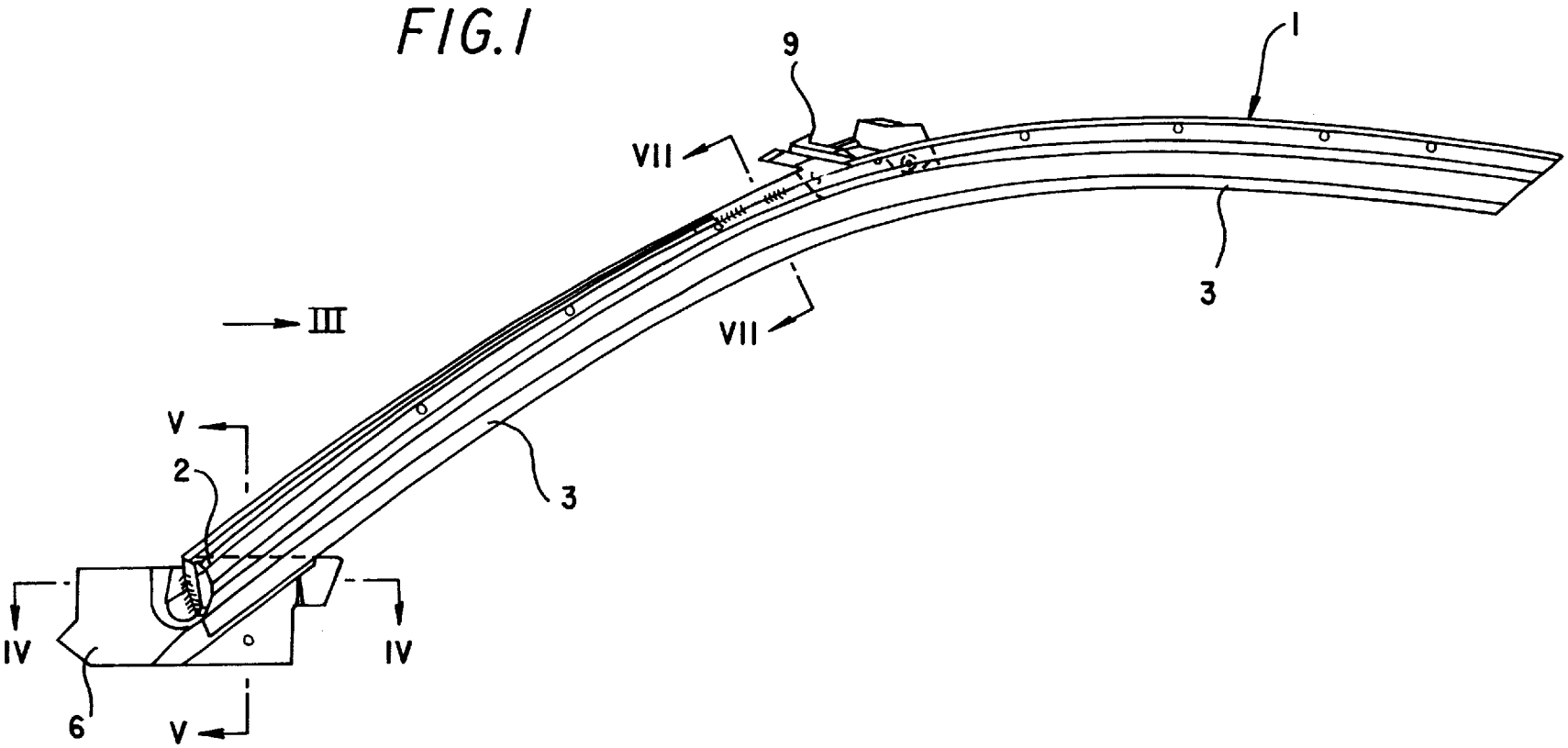
FIG. 1 is a side view of a bent roof side frame according to an embodiment of the present invention.
Figure 2:
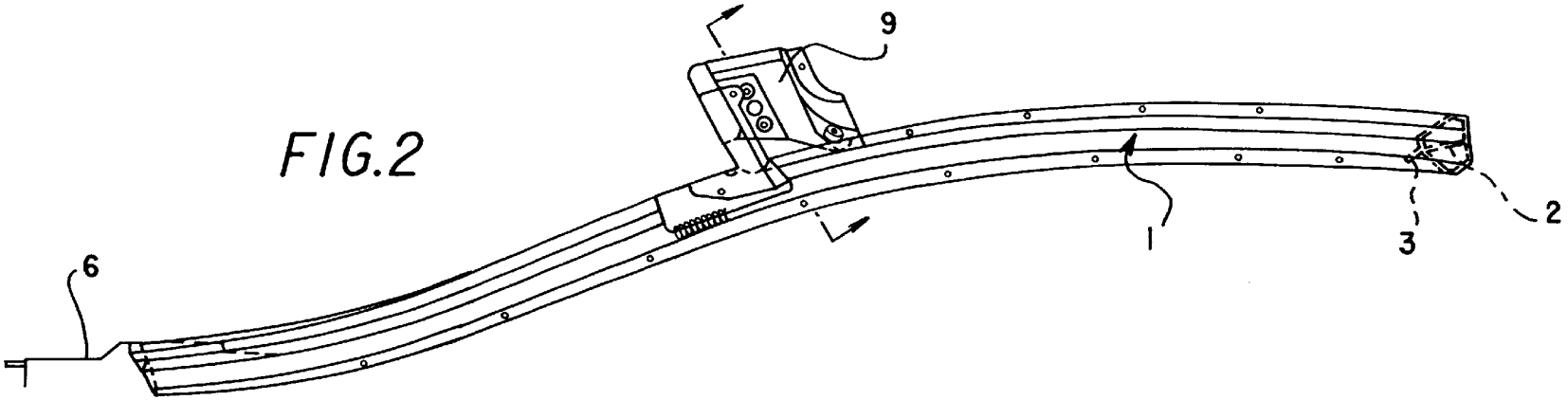
FIG. 2 is a plan view of FIG. 1.
Figure 4:
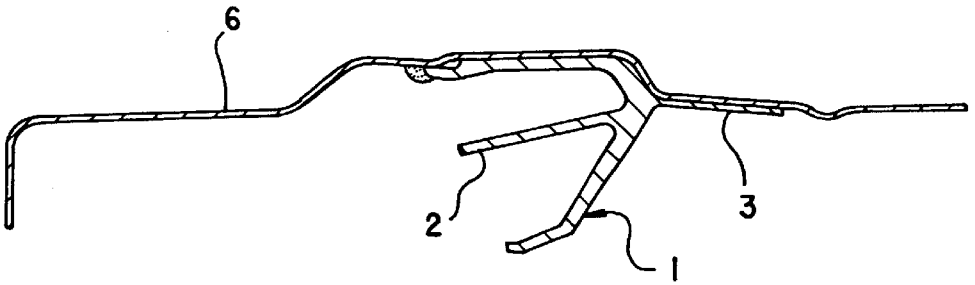
FIG. 4 is a cross-sectional view taken along the line IV—IV of FIG. 1.
Figure 3:
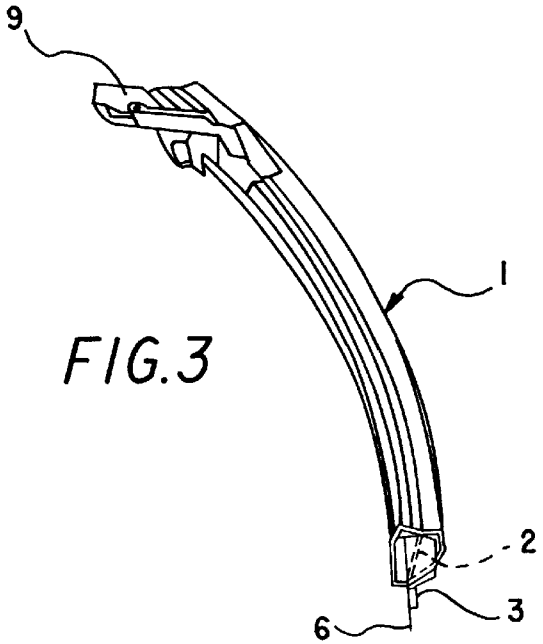
FIG. 3 is a view as seen in a direction indicated by an arrow III of FIG. 1.
Figure 5:
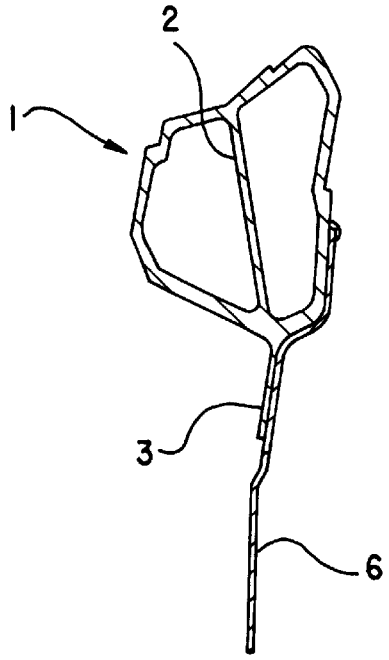
FIG. 5 is a cross-sectional view taken along the line V—V of FIG. 1.
Figure 6:
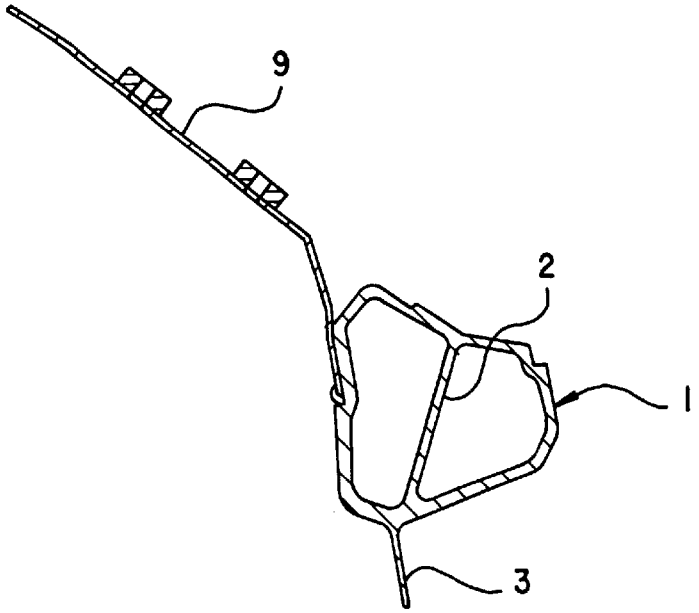
FIG. 6 is a cross-sectional view taken along the line VI—VI of FIG. 2.

In addition, as will be described in detail later, the flange 3 is first subject to a compression plastic deformation, and thereafter the roof side frame 1 is bent using a bending apparatus as described in Japanese Patent Unexamined Publication No. HEI 8-257643; as shown in FIG. 1, the roof side frame is curved as shown in FIG. 1 in an arc-like fashion (only the front half portion being shown in FIG. 1) from the front toward rear of the vehicle body as viewed from the side thereof. In addition, as shown in FIG. 2, the roof side frame 1 is inclined and also curved in an arch-like fashion (only the front half portion being shown in FIG. 2) toward the center from the front to rear of the vehicle body, and the roof side frame 1 is torsionally bent such that the flange 3 is directed downwardly at the front of the vehicle body but is twisted outwardly toward the longitudinal center thereof.

Figure 8:
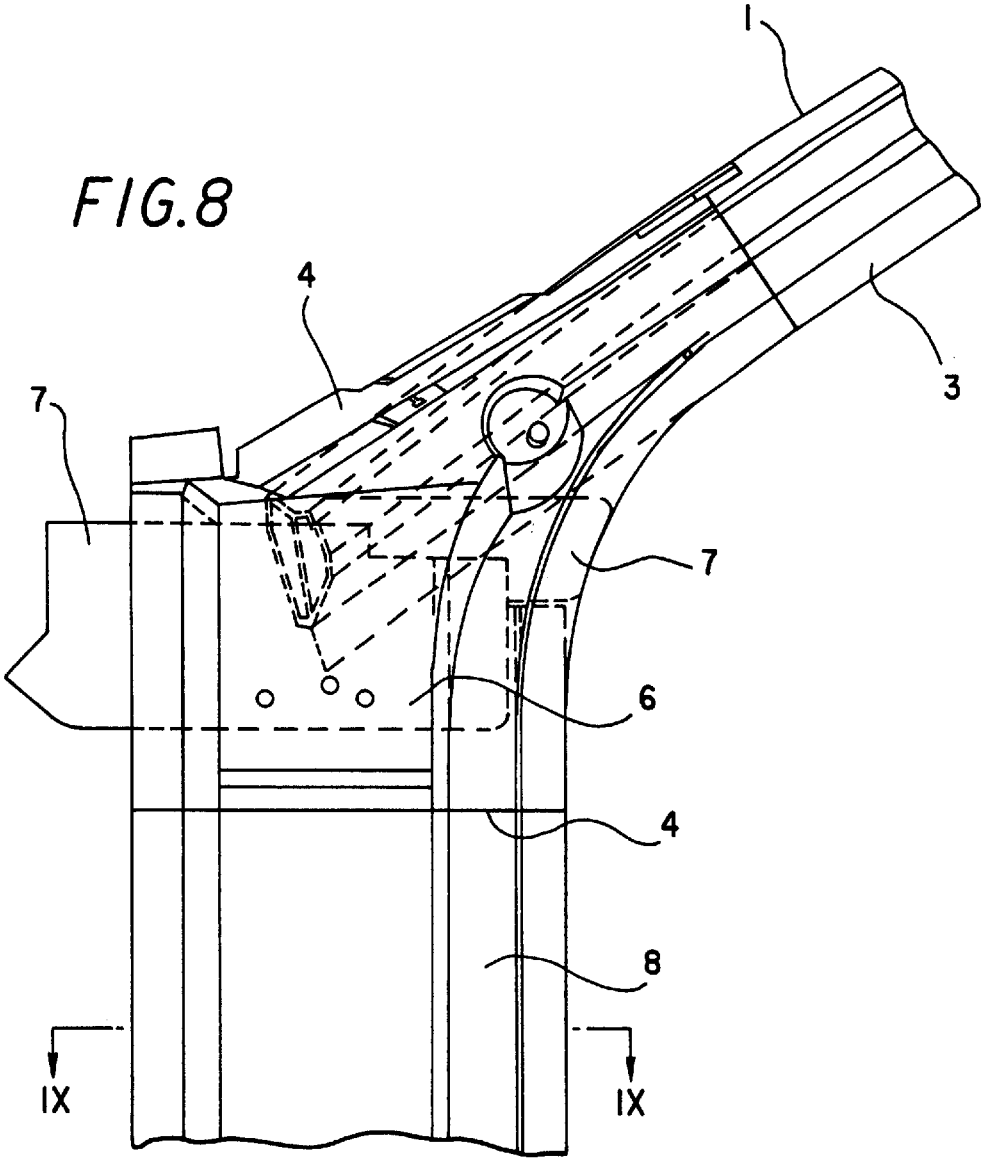
FIG. 8 is an enlarged side view showing a main portion of a joint portion between the roof side frame and a front pillar.
Figure 9:
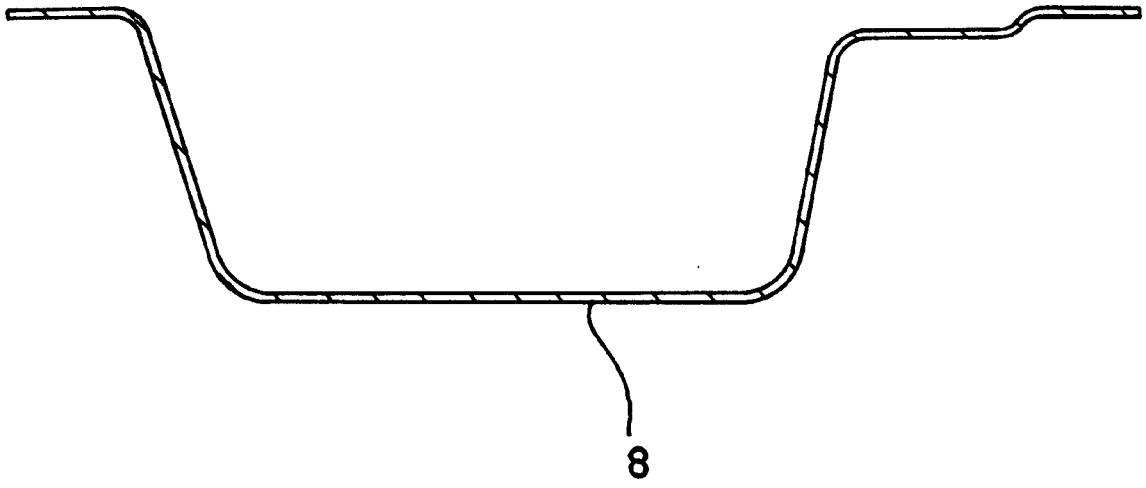
FIG. 9 is a cross-sectional view taken along the line IX—IX of FIG. 8.
Figure 10:
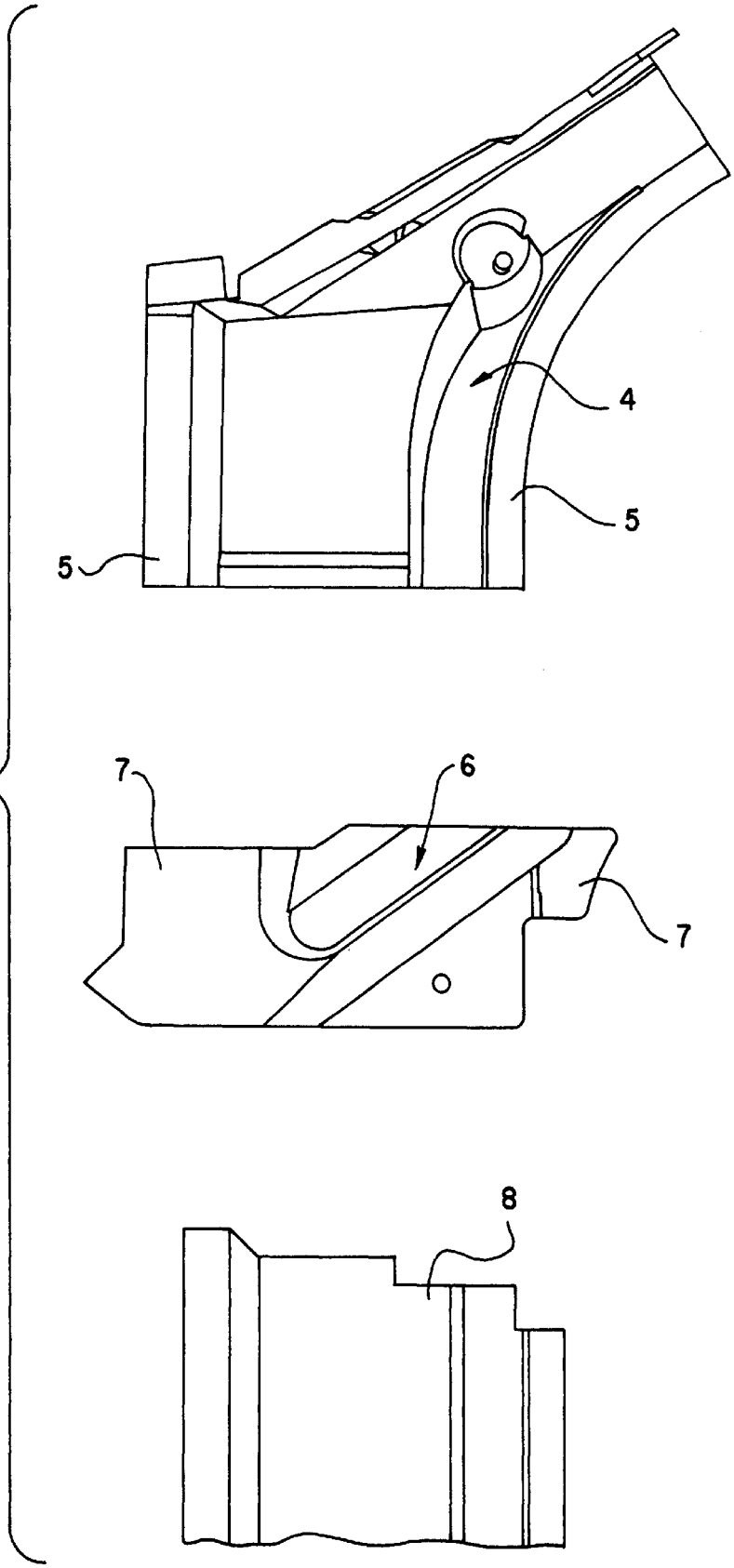
FIG. 10 is an exploded side view showing, respectively, an outer stiffener, an inner stiffener and an upper portion of the front pillar.

Furthermore, as shown in FIG. 10, an outer stiffener 4 is overlaid on an outer side of a front pillar 8 and they are joined together by welding, the outer stiffener 4 having a horizontal cross-sectional configuration identical to that of the front pillar 8. Then, as shown in FIG. 8, the front pillar 8 is applied to an outer side of the roof side frame 1 at a front end thereof and an inner stiffener 6 is applied to an inner side of the roof side frame 1 at the front end thereof. A flange 5 of the outer stiffener 4 and a flange 7 of the inner stiffener 6 are overlapped each. other and spot welded together. In addition, the roof side frame 1, the outer stiffener 4, the inner stiffener 6 and the front pillar 8 are joined together by welding or the like, whereby the roof side frame 1 is integrally securely held between the outer stiffener 4 and the inner stiffener 6.

Furthermore, a roof beam mounting piece 9 is integrally mounted on the roof side frame 1 at the front half portion thereof, and a roof (not shown) is attached to a laterally extending roof beam (not shown) and the roof side frames 1 in an expanded fashion.

The roof side frame 1 has a hollow cross-sectional construction as shown in FIG. 7, and the thickness and width of the flange 3 are, respectively, 1.65 mm ad about 20 mm. As will be described later, when a compressive force is applied to the flange 3 in the thickness direction for compression plastic deformation thereof, the thickness of the flange is reduced by about 0.3 mm, and it comes about 1.35 mm.

Thus, when the compressive force is applied to the flange 3 in the thickness direction thereof for compression plastic deformation thereof, tensile forces are imparted to the flange 3 in a longitudinal direction of the roof side frame 1 and a width direction of the flange 3, and since the flange 3 is subject to elongation plastic deformations in those directions. Therefore, a compressive force is applied to the flange 3 along the longitudinal direction of the roof side frame 1 when the roof side frame 1 is thereafter bent in such a manner that the flange 5 is situated on an inner side of a bending process. However, as a result of a remarkable reduction in yield stress (this phenomenon is referred to as the Bauschinger effect ) when a load is applied in a direction reverse to the direction of the compressing plastic deformation, the flange 3 is prevented from deforming in a wavy fashion, whereby the roof side frame 1 can easily be bent toward the flange 3 side along the flanged surface with the flange 3 being kept substantially flat.

As a result of this, there is needed no post process to correct the flange 3 to restore its flatness, whereby a component such as a molding and a weather strip rubber can securely and efficiently be mounted on the flange 3 with high accuracy.

Next, described specifically will be the construction of a roof side frame bending apparatus 10 and a bending process of bending the roof side frame 1 using this roof side frame bending apparatus 10.

Figure 11:
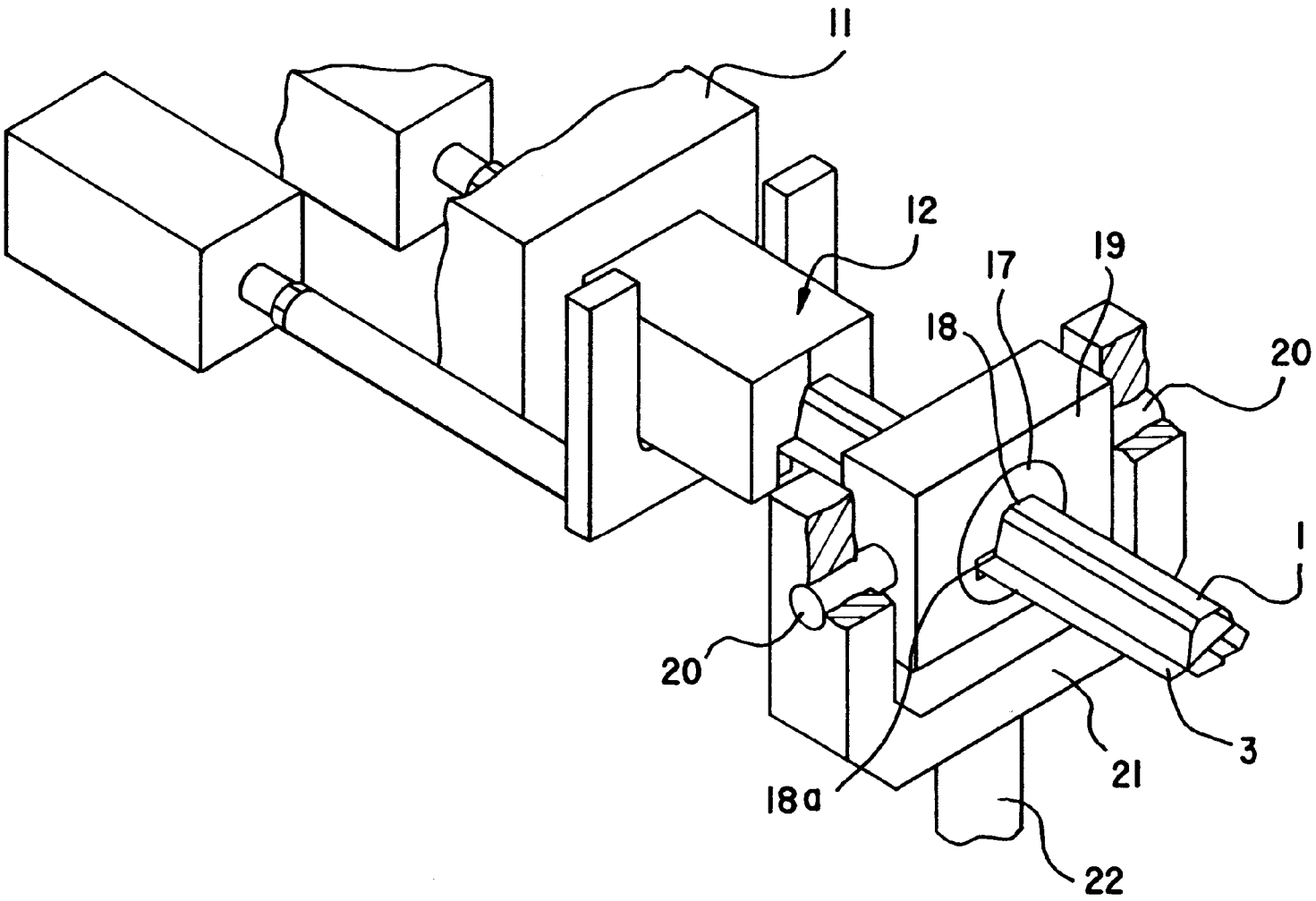
FIG. 11 is a perspective view illustrating briefly a roof side frame bending apparatus.
Figure 12:
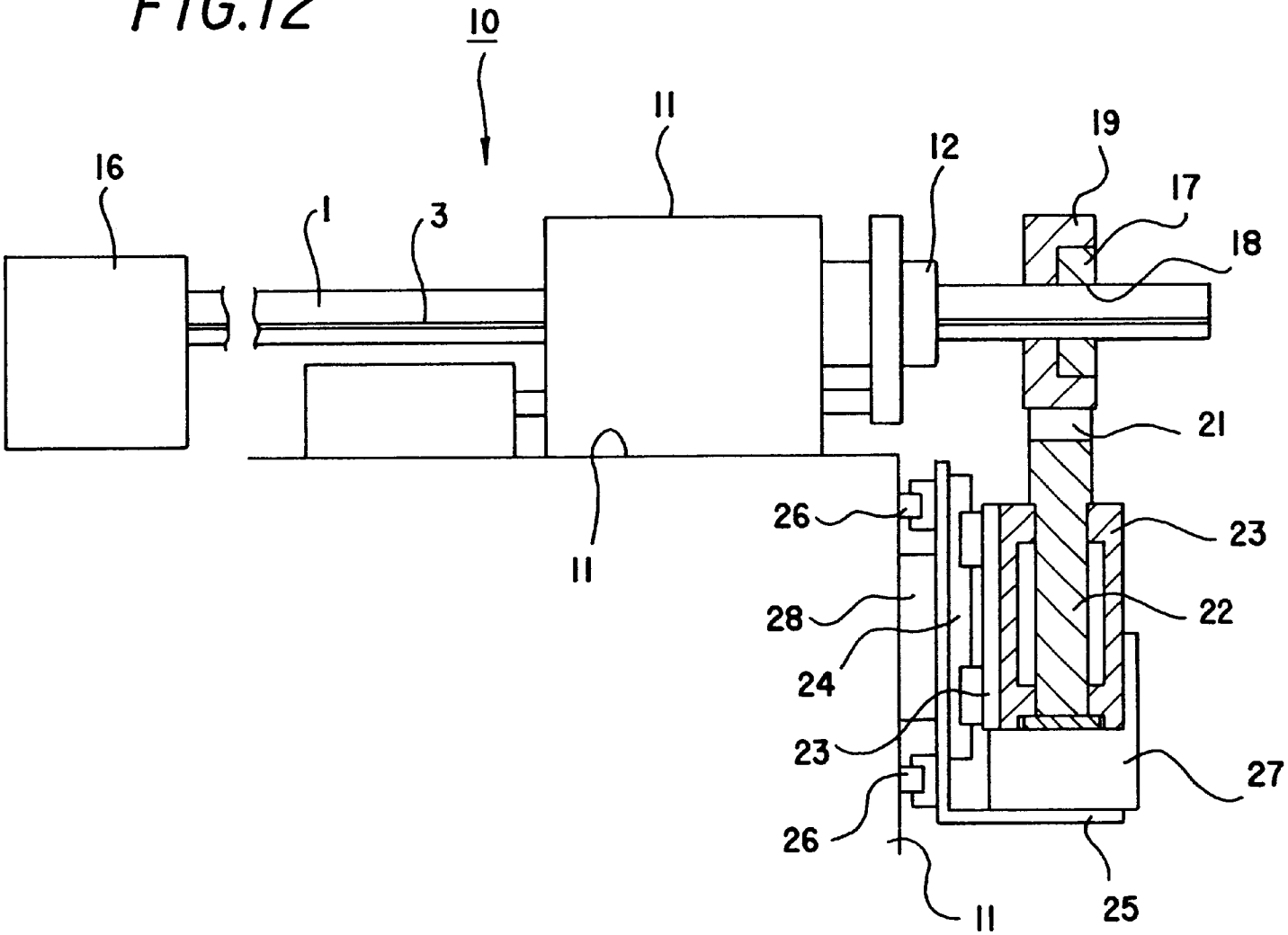
FIG. 12 is a vertically cross-sectional side view of the roof side frame bending apparatus.
Figure 13:
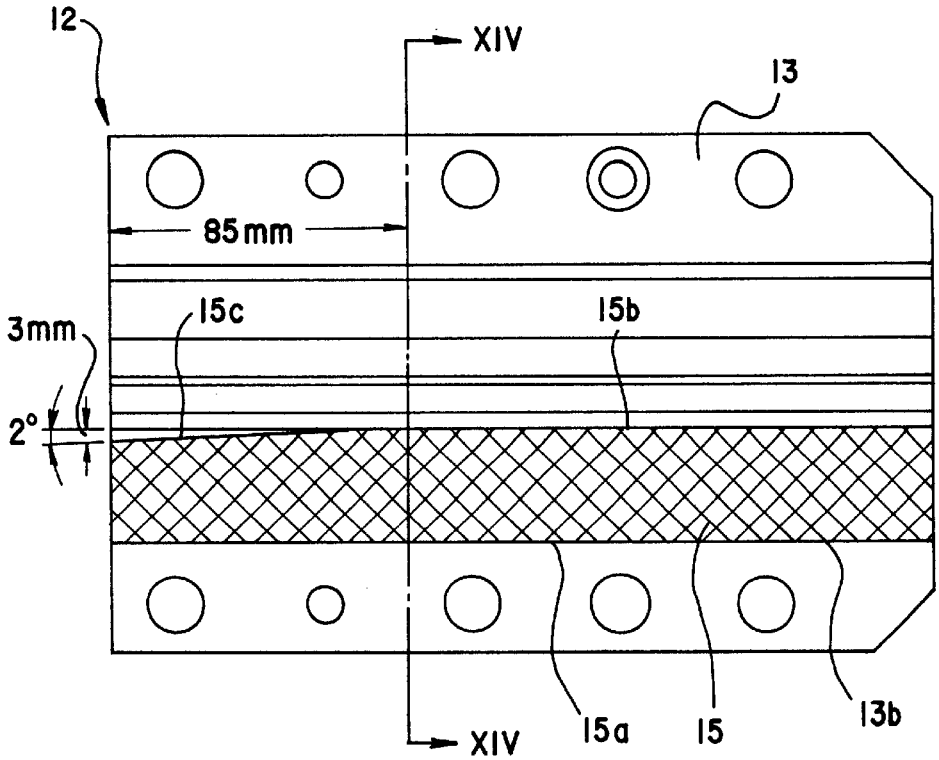
FIG. 13 is a side view of a work fixing mold showing a state in which a female mold is removed therefrom.
Figure 14:
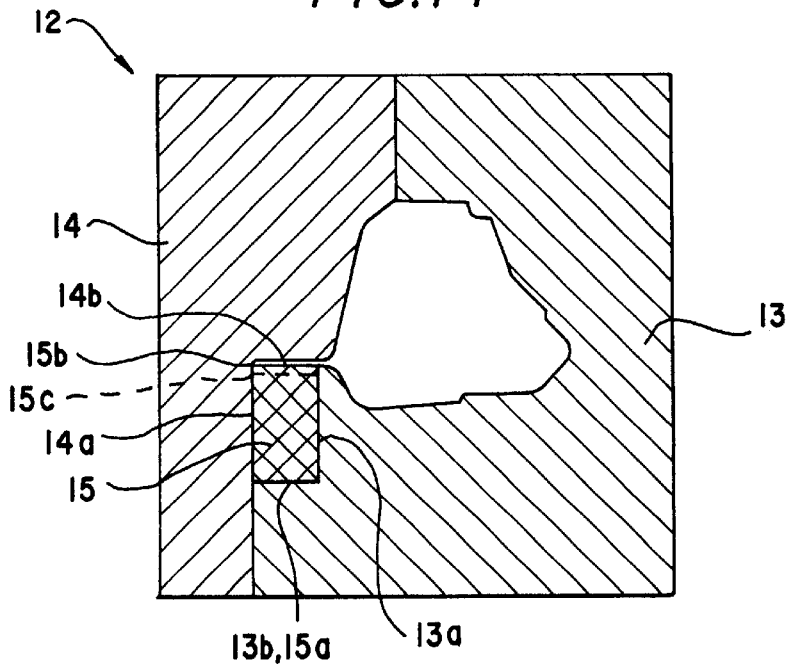
FIG. 14 is a cross-sectional view taken along the line XIV—XIV of FIG. 13.
Figure 15:
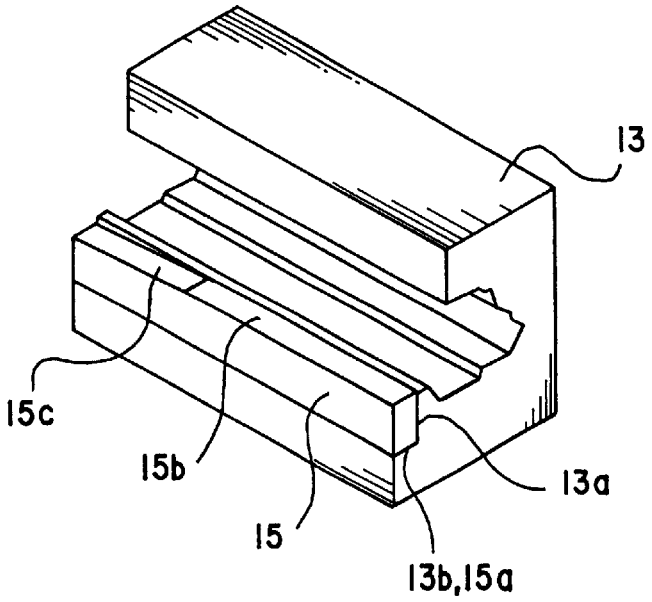
FIG. 15 is a perspective view of the other female mold.

As shown in FIGS. 11 and 12, a work fixing mold 12 is integrally mounted on a bending apparatus main body 11 of the roof side frame bending apparatus 10. As shown in FIGS. 12 to 14, the work fixing mold 12 includes two female molds 13, 14 having formed therein cavities which respectively have configurations substantially identical to corresponding portions of a cross-sectional configuration of the roof side frame 1 and a wiper mold 15 inserted into a notched portion 13*a* formed in the female mold 13 so as to be fixed thereto. These components are detachably joined together one another with bolts (not shown) and a shim having a predetermined thickness (not shown) is interposed between a bottom surface 13*b* of the notched portion 13*a* of the female mold 13 and a bottom surface 15*a* of the wiper mold 15 as required. A upper end portion 15*c* of the wiper mold 15 is inclined downwardly toward an end thereof over a distance of 85 mm at an angle of 2 degrees, and the upper surface of the wiper mold 15 is formed such that a space formed between an imaginary extension of an upper central parallel portion 15*b* of the wiper mold 15 and the end of the inclined end portion 15*c* becomes about 3 mm. The female mold 14 is a member which serves as a receiving member, while the wiper mold 15 serves as a press member. Thus, a main portion of a bending apparatus is constituted by the work fixing mold 12, the female molds 13, 14 and the wiper mold 15, and a work feeding device 16.

In addition, a gap is provided between the upper central parallel portion 15*b* of the wiper mold 15 and a lower surface 14*b* of a notched stepped portion 14*a* of the female mold 14, and this gap measures 1.35 mm and is narrower by 0.3 mm than the flange 3 of the roof side frame 1 which has not been processed.

Moreover, the work feeding device 16 corresponding to a slidably driving unit is disposed rearwardly of the bending apparatus 11, and with this work feed device 16 the roof side frame 1 is constructed so as to be fed and driven forward through the work fixing mold 12.

Moreover, a bending mold 17 having a cross-sectional configuration substantially identical to that of the work fixing mold 12 is disposed forwardly of the work fixing mold 12 with a space of 58 mm being formed therebetween. Formed in this bending mold 17 is a hole 18 allowing the roof side frame 1 to pass therethrough, and as shown in FIG. 11, and a groove portion 18*a* of the hole. 18 adapted to hold therein the flange 3 of the roof side frame 1 is formed so as to leave a gap of 0.5 mm on both flange surfaces of the flange 3.

Then, the bending mold 17 is rotatably fitted in a holding member 19, and this holding member 19 is in turn pivotably supported on an external frame 21 via a horizontal shaft 20 in such a manner that the holding member 19 can be freely inclined vertically. The external frame 21 is also pivotably supported on an elevator table 23 via a vertical shaft 22 in such a manner as to freely be rotated in clockwise and counterclockwise directions. The bending mold 17 can be rotated about a central axis of an outer circumferential cylindrical surface of the bending mold 17 by a rotationally driving mechanism (not shown). Thus, the bending mold 17 and the holding member 19 are constructed so as to be shifted in any of the up, down, clockwise and counterclockwise directions.

In addition, the elevator table 23 is mounted on a lateral movable table 25 via a pair of elevating guide rails 24 disposed on left- and right-hand (front and rear in FIG. 12) sides in such a manner as to freely be raised and/or lowered. The lateral movable table 25 is mounted in turn on the bending apparatus main body 11 via a pair of horizontal guide rails 26 disposed vertically in such a manner as to freely be moved laterally (in back and forth directions in FIG. 12). The elevator table 23 is constructed so as to be driven in vertical directions by means of an elevator driving mechanism 27, and the lateral moving table 25 is constructed so as to be driven in lateral directions by means of a laterally driving mechanism 28.

Operations of bending and twisting the roof side frame 1 will be described below with reference to the roof side frame bending apparatus 10 shown in FIGS. 11 and 12.

The roof side frame 1 applied on the surface thereof with a lubricating oil named Houghto-draw 7002 which is produced by Houghton Japan Co., Ltd. is fed forwardly at a feed speed of 2000 mm/min through the work fixing mold 12. Then,when the roof side frame 1 slidingly passes through the work fixing mold 12, the flange 3 of the roof side frame 1 having a thickness of 1.65 mm is compressed by a lower surface 14*b* of the notched stepped portion 14*a* of the female mold 14 and the inclined end portion 15*c* of the wiper mold 15 so as to be subject to a compression plastic deformation, and the thickness thereof is reduced to 1.35 mm. Accordingly, the flange 3 is then subject to a tensile yield stress exceeding the longitudinal elastic limit of the roof side frame 1, thereby producing an elongation plastic deformation in the same direction.

The roof side frame 1 that has passed through the work fixing mold 12 is fitted in the hole 18 in the bending mold 17. The laterally moving table 25 is then driven by the laterally driving mechanism 28 in a rightward direction (toward the front as viewed in FIGS. 11 and 12) with reference to the travelling direction of the roof side frame 1, and the bending mold 17 is shifted rightward together with the laterally driving mechanism 28 via the holding member 19, the external frame 21, the vertical shaft 22, the elevator table 23, the elevating guide rails 24 and the laterally moving table 25. As a results of this, the roof side frame 1 is bent with the flange 3 being situated on an inner side of a bent being made so as to be curved, and simultaneously with this, the bending mold 17 is vertically raised or lowered by means of the elevator driving mechanism 27. Further, it is rotated through a predetermined angle by means of a rotationally driving mechanism (not shown). As a result of this, the roof side frame 1 is then bent in a direction perpendicular to the direction in which the roof rail frame 1 is bent with the flange 3 being situated on an inner side of a bent made, and further, the roof side frame 1 is twisted in either of the directions.

When the roof side frame 1 is curved in such a manner that the flange 3 is situated on an inner side of a bend, the compression yield stress of the flange 3 is remarkably reduced due to the elongation plastic deformation along the longitudinal direction of the roof side frame 1. Therefore, there is caused a compression plastic deformation directly in the flange 3 along the surface thereof. Thus, the roof side frame 1 is easily bent in such a manner that the flange 3 is situated on an inner side of a bend being made without a risk of the flange 3 being subject to a wavy deformation.

In addition, even if the flange 3 is caused to slightly deform in a wavy fashion, since there exists the gap of 0.5 mm between the flange 3 and the groove portion 18*a* of the hole 18 embracing the flange 3, there is no risk of the side surfaces of the flange 3 being brought into strong contact with the groove portion 18*a* of the hole 18, whereby a failure of the flange 3 which would be caused by the contact friction with the groove portion 18*a* is prevented beforehand.

Shown in a table below are the results of the depths and pitches of wavy wrinkles produced in the flange 3 to which the compression plastic deformation according to the present invention is applied and a flange to which no such compression plastic deformation is applied without using the wiper mold 15 in the work fixing mold 12 when the roof side frame 1 is bent to radii of 400 m and 600 m, respectively.

TABLE 1

| | wrinkles | present invention | conventional method |
|---|---|---|---|
| curvature of 400 m | depth | 0.17 mm | 2.6 mm |
| | pitch | 11.52 mm | 19.65 mm |
| curvature of 600 m | depth | 0.14 mm | 2.68 mm |
| | pitch | 10.26 mm | 24.65 mm |

As is clear from the results of this experiment, the generation of wrinkles in the flange 3 is so slight that it cannot be detected visually, and therefore the accuracy is remarkably improved at which a component is attached to the flange 3.

Furthermore, below are the results of an experiment in which bending was carried out to radii of curvatures of in the order of about 30 to 53 m.

TABLE 2

| No | radius of curvature (m) | A | B | C | D | E | F | G |
|---|---|---|---|---|---|---|---|---|
| 1 | 53.12068 | −0.3 | 0 | 0 | 1.43 | 1.35 | 20 | 19 |
| 2 | 39.80436 | −0.3 | 0 | 0 | 1.44 | 1.36 | 20 | 19 |
| 3 | 30.88935 | −0.3 | 0.81 | 16.99 | 1.46 | 1.35 | 20.5 | 19 |

TABLE 2-continued

| No | radius of curvature (m) | A | B | C | D | E | F | G |
|---|---|---|---|---|---|---|---|---|
| 4 | 33.08778 | −0.3 | 0.53 | 15.53 | 1.46 | 1.37 | 20 | 19 |
| 5 | 40.32742 | −0.3 | 0.47 | 15.77 | 1.5 | 1.4 | 20 | 19 |

A compression amount (mm)
B wrinkle depth
C wrinkle pitch
D flange thickness R portion
E flange thickness linear portion
F flange height R portion
G flange height liner portion According to the results of this experiment, there were cases where no wrinkle was produced as seen in Nos. 1 and 2.

In addition, the shim, which is not shown in the figures, is used to regulate the amount of compression deformation, and the protruding distance of the wiper mold 15 may be changed by varying the thickness of the shim or hydraulically.

As the radius of curvature becomes smaller, it is preferable that the compression plastic deformation amount of the flange 3 is increased for compensation.

Furthermore, the roof side frame 1 bending and twisting apparatus does not necessarily have to be the roof side frame bending apparatus 10 but it may be applied to other bending apparatuses.

Figure 16:
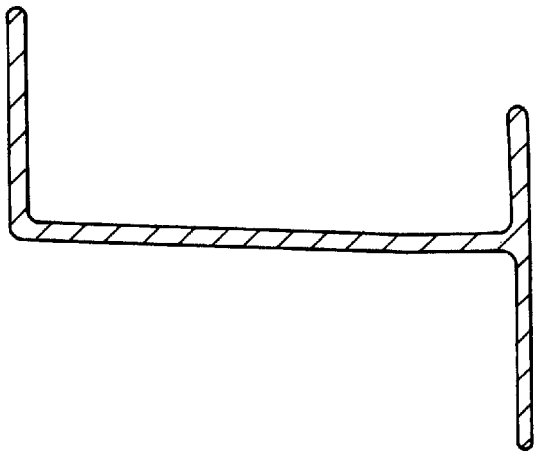
FIG. 16 is a cross-sectional view of a metallic flanged member showing another cross-sectional configuration.

Moreover, a member to be bent does not necessarily have to be a hollow member like the roof side frame 1 but even a metallic channel member or a modified metallic channel member as shown in FIG. 16 may also be bent likewise.

What is claimed is:

1. A method for bending a metallic flanged member, comprising the steps of:

applying a compressive force to solely a flange of a metallic flanged member in a direction that intersects a longitudinal direction of said metallic flanged member to provide compression plastic deformation to said flange without applying such compressive force to the remainder of the metallic flanged member, so that the remainder is not subject to compression plastic deformation; and bending said metallic flanged member along a flange surface thereof in such a manner that said flange of said metallic flanged member is situated on an inner side of the bend.

2. A method as set forth in claim 1, wherein said compressive force is directed in a thickness direction of said flange being a direction perpendicular to said flange surface.

3. A method as set forth in claim 1, wherein the amount of said compression plastic deformation is increased as the bending radius of said metallic flanged member decreases.

4. An apparatus for bending a metallic flanged member comprising:

a receiving member slidably supporting said metallic flanged member and abutting against one surface of a flange of said metallic flanged member;

a press member integrally fixed to said receiving member, said press member having an abutment surface abutting solely against the other surface of said flange to thereby form a gap between said abutment surface and another abutment surface of said receiving member abutting against said one surface of said flange, said gap being gradually reduced from one end of said flange to the other end thereof;

a slidably driving unit slidably moving said metallic flanged member in a direction along a longitudinal axis of the metallic flanged member from one side of said receiving member where said gap formed between said abutment surface of said receiving member and said another abutment surface of said press member is larger toward the other side where said gap is smaller, so as to compressively plastic deform solely said flange of said metallic flanged member by successively moving the flange from the larger gap to the smaller gap; and a bending mold, for receiving said metallic flanged member following plastic deformation of the flange, for providing bending force to said member in directions perpendicular to said longitudinal axis and rotational forces to said member about said longitudinal axis.

5. A method as set forth in claim 1, further comprising:

applying a force along a longitudinal direction of said metallic flange member to push said member for movement in said longitudinal direction.

* * * * *